United States Patent [19]

Meyers

[11] Patent Number: 4,978,012

[45] Date of Patent: Dec. 18, 1990

[54] APPARATUS FOR MOUNTING CLIPS AND FIXTURE THEREFOR

[76] Inventor: Jonathan H. Meyers, 221 Arleigh Rd., Douglaston, N.Y. 11363

[21] Appl. No.: 337,372

[22] Filed: Apr. 13, 1989

[51] Int. Cl.[5] ..... A47F 7/00

[52] U.S. Cl. ..... 211/49.1; 206/342; 206/493; 206/499

[58] Field of Search ..... 211/59.1, 57.1, 49.1; 206/493, 342, 499; 108/55.3

[56] References Cited

U.S. PATENT DOCUMENTS

| | | | |
|---|---|---|---|
| 996,150 | 6/1911 | Shaw | 211/59.1 X |
| 2,906,410 | 9/1959 | McGuire | 211/59.1 |
| 2,971,768 | 2/1961 | Ackley et al. | 108/55.3 X |
| 3,009,625 | 11/1961 | Ackley et al. | 211/59.1 X |
| 4,170,299 | 10/1979 | Clements . | |
| 4,424,905 | 1/1984 | Keen | 211/49.1 |
| 4,465,186 | 8/1984 | Meyers . | |
| 4,527,689 | 7/1985 | Meyers . | |

*Primary Examiner*—Blair M. Johnson
*Attorney, Agent, or Firm*—James & Franklin

[57] ABSTRACT

The base has elongated clip receiving elements permanently affixed thereto which extend in parallel, spaced relation. Apertures are provided in the base proximate to each of the clip receiving elements. The apertures are adapted to receive elongated rotation preventing elements therein. Each rotation preventing element and clip receiving element proximate thereto is received within the elongated clip opening so as to prevent rotation of the clips during mounting on the base. The rotation preventing elements can be affixed to the base or can be part of a separate fixture over which the base is placed while the clips are mounted. The rotation preventing elements are removed from the base prior to shipping.

10 Claims, 4 Drawing Sheets

APPARATUS FOR MOUNTING CLIPS AND FIXTURE THEREFOR

The present invention relates to an apparatus for packaging plastic clips and a fixture for use therewith and more particularly, to structure which can be part of the apparatus or of a fixture upon which the apparatus is placed during mounting of the clips, and which prevents rotation of the clips prior to banding.

Plastic clips of the type which the present invention is design to mount are sometimes referred to as "tie-back" clips and have substantially "U-shaped" bodies. Such clips are commonly fabricated of molded plastic material and may be provided with internal serrated edges to enhance the ability of the clip to grip an article. The clips are often provided in pairs connected to each other by an elastic or non-elastic string-like member. The ends of the string-like member are usually formed in loops and each loop passes through the elongated opening of a different clip in the pair.

The clip pairs are used for a wide variety of different applications, including the display, sale, and packaging of soft goods such as clothing and the like. Commonly, the clips are used to attach related articles to each other. For example, pairs of gloves, bathing suit tops and bottoms or matching blouses and skirts may be associated and sold in this manner.

Clips of this type are a very low price item and must therefore be manufactured, packaged and shipped as inexpensively as possible. Accordingly, any packaging for the clips must itself be low in cost. Further, in order to avoid increased shipping costs, the packaging should not add substantially to the weight or the bulk of the clips.

Aside from cost and weight considerations, packaging of clip pairs of this type presents certain problems due to the tendency of the interconnecting string-like members to become entangled, preventing the easy removal of a single clip pair from a group of clip pairs. If the clip pairs are simply placed randomly in a carton, the string-like connecting members often become so entangled with each other that it becomes virtually impossible to remove the clip pairs from the carton one at a time. For this reason, various packaging techniques have been utilized in an attempt to prevent tangling and, thus, facilitate the use of the clips.

One such packaging technique has been to align the clips in side-by-side relation so as to form an assembly and thereafter wrap the assembly in heat-shrinkable plastic or the like. While this method stabilizes the individual clips during shipment, it has the disadvantage that the clips will fall randomly into a bunch when the wrapping is removed and tangle as each clip pair is removed.

An improvement on the above packing method employs a pair of parallelly-situated bars or the like. A group of clips is aligned such that one of the bars can be passed through the openings therein. Groups of aligned clips, with the bars inserted therein, are then placed in side-by-side relation and wrapped. While this method also stabilizes the clips during shipping, when the wrapping is removed, the groups of clips fall apart, are difficult to remove individually from the inserted bars and still become entangled to some extent.

An attempt to further improve upon the above method is disclosed in U.S. Pat. No. 4,170,299, issued Oct. 9, 1979 to Alan Clements and entitled "Rack and Tie Clip Assembly". That patent teaches a rack which includes an end plate and a pair of spaced bars mounted to the plate. Each of the bars is manufactured separately from the plate and thereafter loosely mounted to the plate in a manner which permits the bars to move through a limited arc relative to the plate. A group of aligned clips is received over each of the bars by inserting the bar through the opening in the clips. The cross-sectional shape of the bar corresponds roughly to the elongated shape of the openings in the clip so as to reduce rotation of the clips relative to the bar. The groups of clips are situated adjacent each other on the plate and a rubberband or the like is wrapped around the clip and the plate during shipping.

In actual usage, it has been found that the rack disclosed in the above-mentioned Clements patent has several disadvantages. The disadvantages relate to the bars, which are provided to maintain the clips relative to the plate. To ensure that the clips do not rotate relative to the plate as they are mounted, the bars must have a cross-sectional shape which roughly corresponds to the elongated openings in the clips. In order to form the bars in the required cross-sectional shape, it is necessary to mold the bars separately from the plate and, thereafter, attach the bars to the plate in a separate operation. This results in bars which are not joined tightly to the plate but which can move through a limited arc with respect thereto.

Moreover, molding the bars with this cross-sectional configuration utilizes a relatively large amount of plastic material, thereby adding substantially to the cost and the weight of the rack. This results in increased manufacturing and shipping costs.

The relatively heavy bars are shipped with the clips even though the rotation-preventing function of the bars is required only during the initial stages of the packing operation, that is, prior to the banding of the clips. Once the clips are banded to the rack, the band itself prevents rotation of the clips. Although the bars provide no function after banding, they cannot be removed prior to shipping.

A further improvement on the clip-holding apparatus is disclosed in my U.S. Pat. No. 4,465,186, issued Aug. 14, 1984 and entitled "Holder For Clips". That patent discloses a holder in which the clips are received on spaced elements extending in parallel relation from opposite ends of a base such that sets of two side-by-side clips can be situated in parallel planes. Spaced clip retaining elements extend in parallel relation from the intermediate portion of the base. The clips are received between the clip retaining elements to prevent rotation thereof. A removable banding member may be provided for preventing the displacement of clips until use.

While the holder described in my U.S. Pat. No. 4,465,186 was an improvement over previous holders in that the clip retaining elements could be molded integrally with the base and hence, would not be movable relative thereto, the clip retaining elements still added weight to the holder during shipping, without providing any benefit after banding. Although it is possible to remove the clip retaining elements prior to shipment, this requires additional labor and is hence uneconomical.

A further improvement is disclosed in my U.S. Pat. No. 4,527,689, issued Jul. 5, 1985 and entitled "Method And Apparatus For Mounting Clips". In that patent, each of the clip receiving elements has removably mounted thereto a member which serves to prevent rotation of the clips during mounting. The clips are encircled by a band which passes through opposing indentations in the base. After banding, the rotation preventing members are removed by breaking the connecting parts which mount same to the clip receiving elements.

It should be clear that the holder disclosed in my U.S. Pat. No. 4,527,689 has the advantage over the prior holders of having rotation preventing members which can be removed prior to shipment and hence, reduce the overall shipping weight. This structure has the additional advantage of permitting the material from which the rotation preventing members is fabricated to be recycled and used again. Specifically, the entire holder, including the rotation preventing members, is made of injection molded plastic. The removed rotation preventing members can be melted and the material reused.

The present invention relates to a still further improved apparatus for mounting clips which can be used in one of two ways. In a first embodiment, the rotation preventing members are molded separately from the holder and frictionally engaged within apertures in the base of the holders during clip mounting. The rotation preventing members can be removed after banding such that the holder can be shipped with minimum weight. Because the rotation preventing members are separate from and removably mounted on the base, they can be used repeatedly without the requirement that they be remolded.

In a second preferred embodiment, the same base structure is used in conjunction with a fixture over which the base is placed as the clips are mounted. The fixture includes the rotation preventing members. After the clips are mounted and banded, the holder is removed from the fixture and hence when shipped it has no rotation preventing members thereon. In this instance, the fixture can be made of metal or other rigid material and be used repeatedly without incurring molding costs.

It is, therefore, a prime object of the present invention to provide an apparatus for mounting clips and a fixture for use therewith which includes a base with apertures for receiving removable rotation preventing means.

It is another object of the present invention to provide an apparatus for mounting clips and a fixture therefor which reduces material costs by eliminating the necessity for remolding rotation preventing members.

It is another object of the present invention to provide an apparatus for mounting clips and a fixture therefor which reduces shipping costs by reducing the weight of the holder during shipping.

It is another object of the present invention to provide an apparatus for mounting clips and a fixture therefor which is inexpensive to fabricate and ship.

It is another object of the present invention to provide an apparatus for mounting clips and a fixture therefor wherein the fixture may be made of metal and hence have a long, useful life.

In accordance with one aspect of the present invention, an apparatus is provided for mounting clips having elongated openings. The apparatus includes a base, elongated clip receiving elements permanently affixed to and extending from the base in substantially parallel, spaced relation and apertures in the base, associated with and proximate to each of the receiving elements. The apertures are adapted to receive elongated rotation preventing means therein such that the rotation preventing means extends from the base in substantially parallel relation to the receiving element proximate thereto. The rotation preventing means and the receiving element proximate thereto are adapted to be received within the elongated clip opening so as to prevent rotation of the clips during mounting thereof on the base.

The rotation preventing means comprises an elongated rotation preventing element. Means are provided on the element for frictionally engaging the base aperture. Preferably, the rotation preventing element has a substantially circular cross-section.

A fixture may be provided by use with the clip holding apparatus. The fixture comprises rotation preventing means. The base is adapted to be placed on the fixture such that the rotation preventing means extend through the apertures during mounting of the clips on the base. Thereafter the base is removed from the fixture.

The fixture includes a support and elongated rotation preventing means. The elongated rotation preventing means extend from the support in substantially parallel relation and are spaced apart a distance substantially equal to the distance of the apertures on the base.

Stop means are preferably provided on the elongated rotation preventing means. Preferably, the rotation preventing means comprises first and second spaced rotation preventing elements.

The base apertures have a larger inner dimension than the outer dimension of the rotation preventing elements. In fact, the base apertures are preferably substantially circular and the rotation preventing elements have a substantially circular cross-section.

In accordance with another aspect of the present invention, a fixture is provided for cooperating with a base for preventing the rotation of clips of the type having elongated openings during mounting on a base. The base is of the type which has spaced, substantially parallel elongated clip receiving elements mounted thereon and an aperture proximate each of the clip receiving elements. The fixture includes first and second spaced substantially parallel rotation preventing elements adapted to align with and extend through the base apertures such that each rotation preventing element and the clip receiving element proximate thereto is receivable within an elongated clip opening so as to prevent rotation of the clips during mounting thereof on the base.

To these or such other objects which may hereinafter appear, the present invention relates to an apparatus for mounting clips and a fixture therefor as set forth in detail in the following specification, taken together with the accompanying drawings wherein like numerals refer to like parts and in which.

Figure 2:
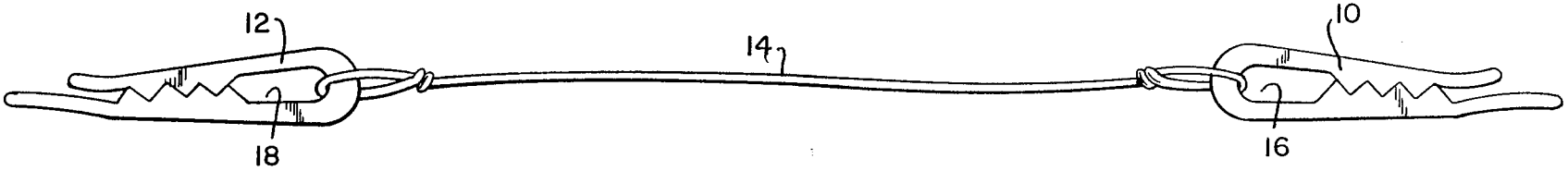
FIG. 2 is a plan view of a pair of tie-back clips of the type which the apparatus of the present invention is designed to mount.

FIG. 2 illustrates tie-back clips of the type the apparatus of the present invention is designed to mount. The tie-back clips are provided in pairs 10, 12 connected by a string-like elastic or non-elastic element 14. Each of the clips 10, 12 has a generally U-shaped configuration defining a generally elongated opening 16 and 18. The inner surfaces of the clip are provided with a serrated edge designed to grip a sheet of material therebetween. The clips are generally made of injection molded plastic which has a resiliency sufficient to permit the clips to be spread and thereafter released to provide the necessary clamping action.

Figure 1:
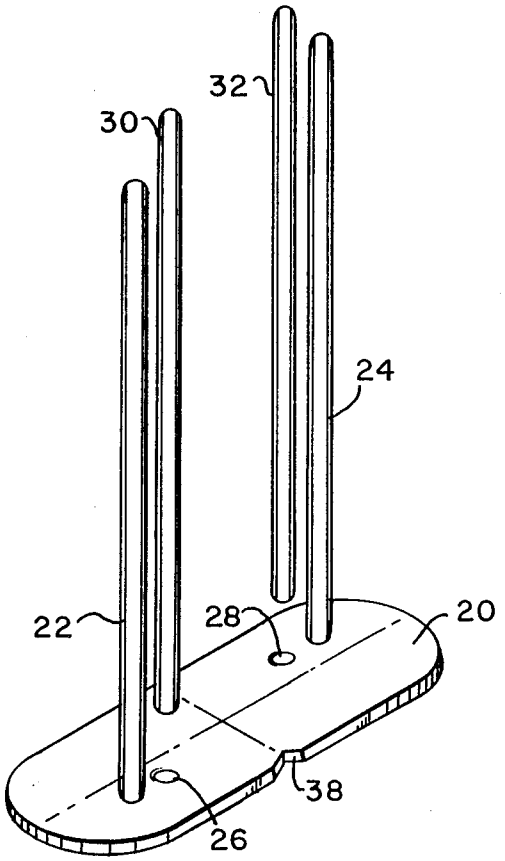
FIG. 1 is an exploded isometric view of the apparatus for mounting clips of the present invention illustrating its use with detachable rotation preventing elements.

FIG. 1 illustrates the apparatus for mounting clips of the present invention. The apparatus includes a base 20 which has a generally elongated configuration which is preferably rectangular with rounded corners or oval. Extending outwardly from the upper surface of base 20 are a pair of spaced clip receiving elements in the form of rods 22 and 24. Rods 22 and 24 are permanently affixed to base 20 and preferably integral therewith. Because of cost and weight considerations, base 20 and rods 22 and 24 are preferably formed of injection molded plastic.

Through base 20 adjacent each rod 22, 24 is an aperture 26, 28 respectively, dimensioned to frictionally engage a removable rotation preventing element in the form of a rod 30, 32. Rods 30, 32 are preferably formed of the same injection molded plastic as base 20 and rods 22, 24.

Figure 3:
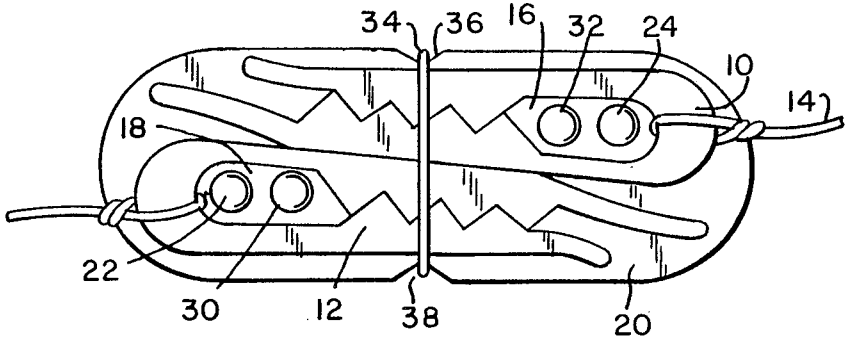
FIG. 3 is a top view of the apparatus illustrated in FIG. 1 after the clips have been mounted thereon and banded.
Figure 4:
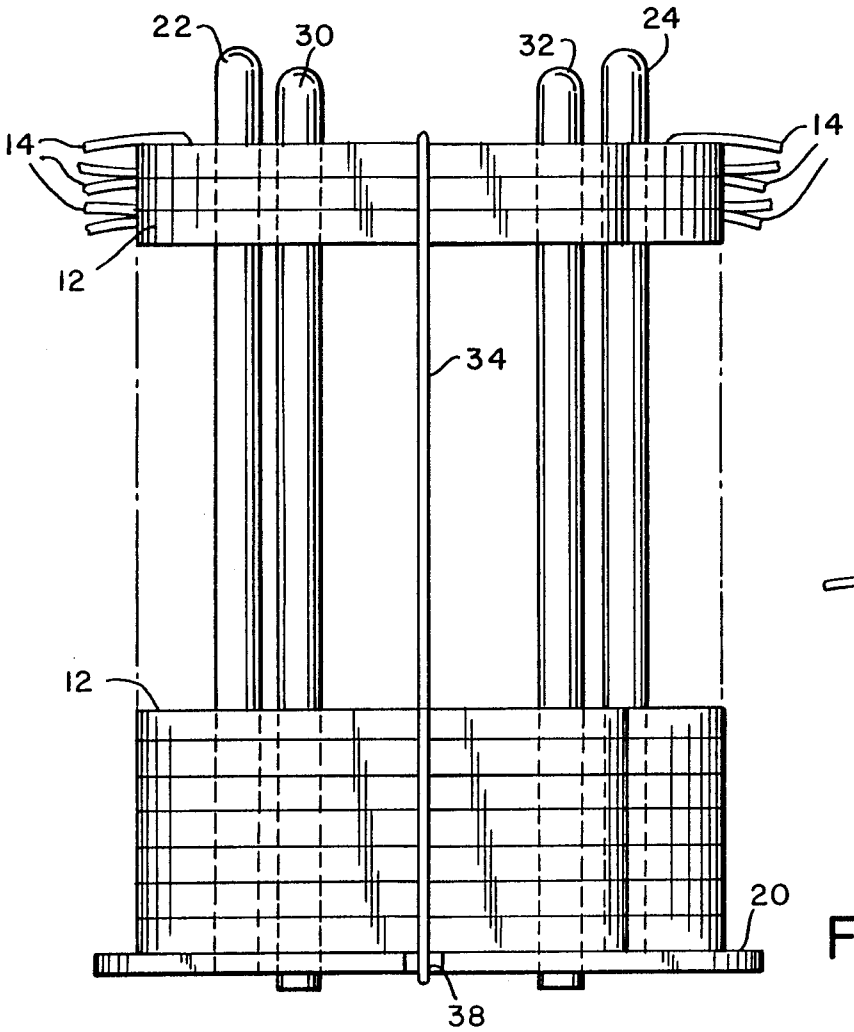
FIG. 4 is a side view of the apparatus illustrated in FIG. 3.

As best seen in FIGS. 3 and 4, when rods 30, 32 are securely in place on base 20, each clip receiving element and its proximate rotation preventing element 24, 32 and 22, 30 form a pair and cooperate as an upstanding structure upon which clips 10 and 12 of each pair can be respectively mounted. Because each structure includes two generally parallel spaced rods, once mounted the clips cannot rotate freely and will remain in the required orientation with respect to base 20 until banded. Banding may take place with a conventional rubberband 34 or any similar element such as plastic skink wrap or the like, which is placed around the clips and base 20 proximate the middle thereof. Base 20 is provided with recesses 36 and 38 to facilitate the proper location of band 34.

After the assembly of clips has been banded, the clips can no longer rotate relative to the clip receiving elements. Hence, the purpose of the rotation preventing elements has been fulfilled. Accordingly, to save weight during shipment and to decrease costs by recycling plastic material, rods 30 and 32 are removed from base 20 by pulling them from apertures 26 and 28, respectively.

Figure 5:
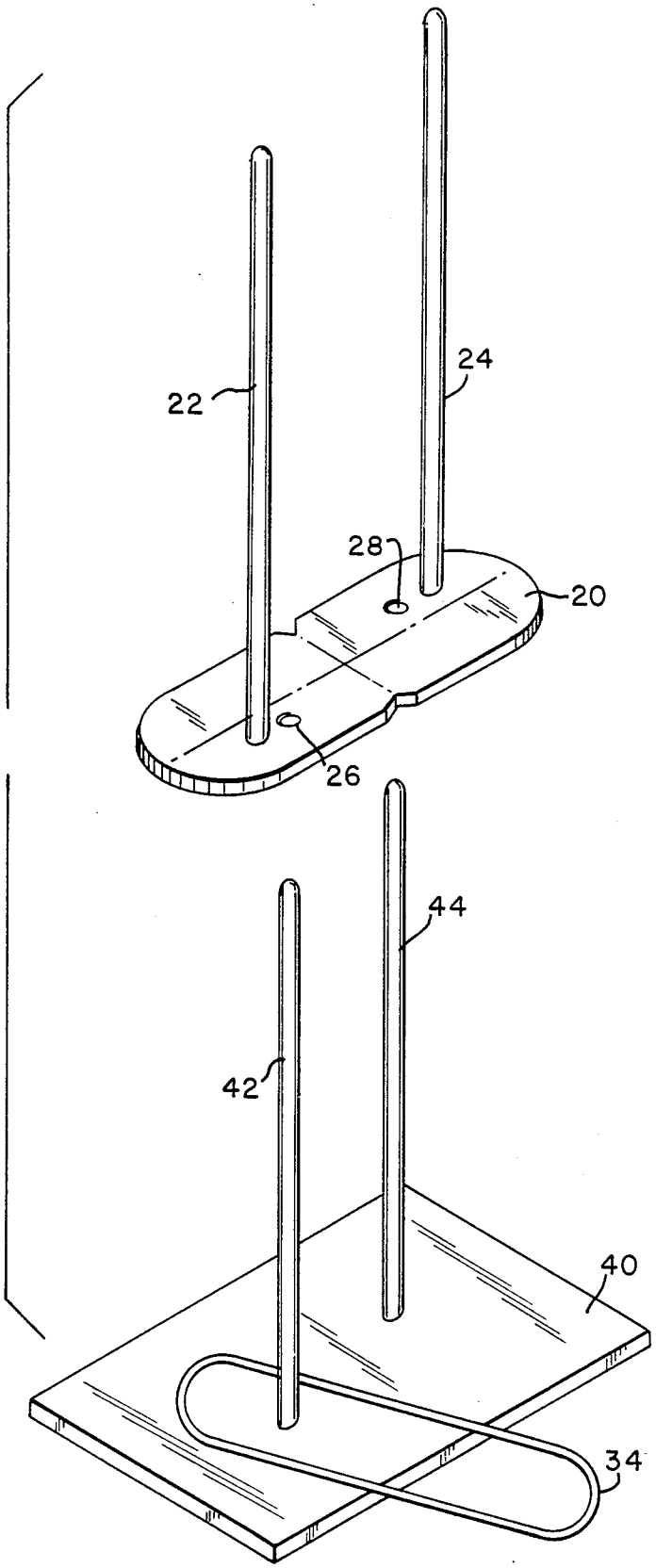
FIG. 5 is an exploded isometric view of the apparatus for mounting clips of the present invention and a fixture for use with same.
Figure 6:
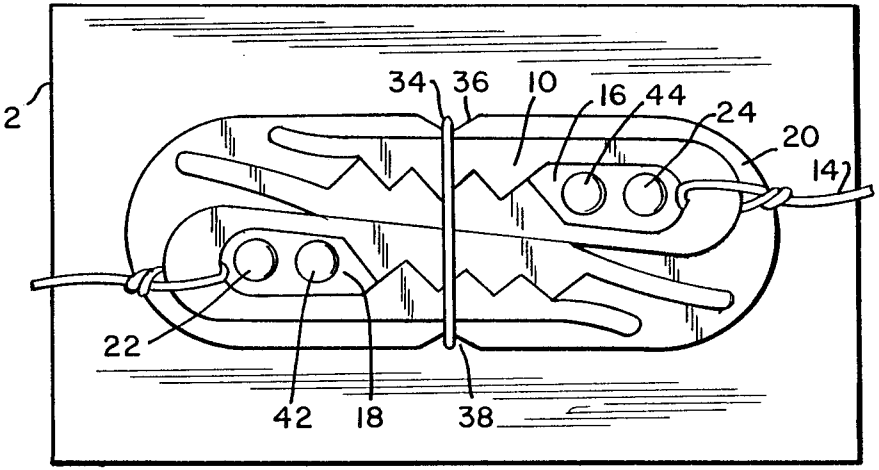
FIG. 6 is a top view of the apparatus of the present invention illustrated in FIG. 5 showing same after the clips have been mounted thereon.
Figure 7:
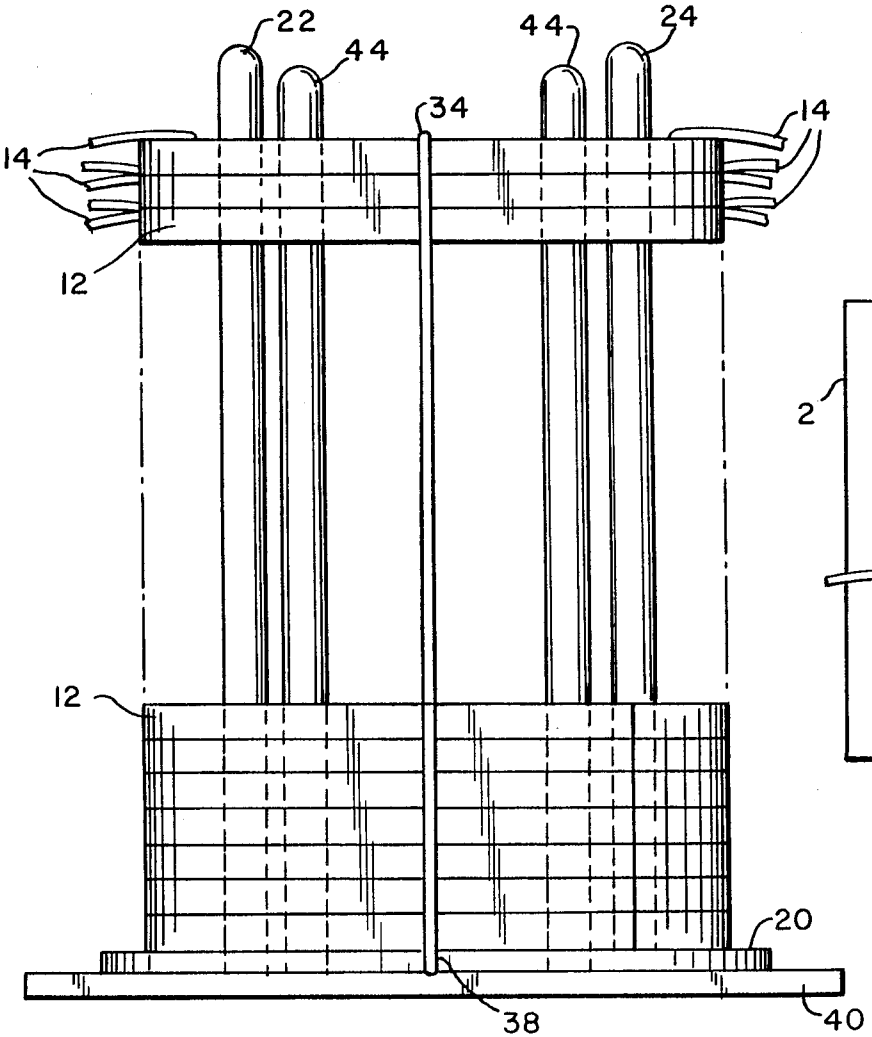
FIG. 7 is a side view of the apparatus shown in FIG. 6.

FIGS. 5, 6 and 7 illustrate how the apparatus of the present invention is used in conjunction with an especially designed fixture which includes a support 40 and a pair of spaced rotation preventing elements in the form of rods 42 and 44. Rods 42 and 44 have a smaller diameter than apertures 26 and 28 and are spaced on support 40 such that they will extend through apertures 26 and 28 on base 20 as base 20 is situated on support 40. Base 40 and rods 42 and 44 may be formed of plastic, but are preferably formed of metal so that they can be used repeatedly without substantial wear. Moreover, the extra strength of metal will better maintain the separation between the rods so as to facilitate mounting of the apparatus thereon.

Once base 20 has been situated on support 40, the clips are mounted thereon in the same manner as in the embodiment shown in FIGS. 1, 3 and 4. After all of the clips have been mounted, band 34 is stretched over the clips and the assembly appears as illustrated in FIGS. 6 and 7. The clip mounting apparatus may now be removed from support 40 by pulling same upwardly away from the support and be prepared for shipment.

It will now be appreciated that the present invention relates to an apparatus for mounting clips which includes a base with spaced elongated clip receiving elements permanently affixed thereto, which extend in parallel relation. Apertures are provided in the base proximate each of the clip receiving elements. The apertures are adapted to receive elongated rotation preventing elements therein. Each rotation preventing element and clip receiving element proximate thereto is received within the elongated clip opening so as to prevent the rotation of the clips during mounting on the base. The rotation preventing elements can be affixed directly to the base or can be part of a separate fixture over which the base is placed while the clips are mounted. In either case, they are removed from the base prior to shipping.

While only a single preferred embodiment of the present invention has been disclosed herein, it is obvious that many variations and modifications could be made thereto. It is intended to cover all these variations and modifications which fall within the scope of the present invention as defined by the following claims:

I claim:

1. Apparatus for mounting clips having elongated openings, comprising a base, clip receiving elements permanently affixed to and extending from said base in substantially parallel, spaced relation and apertures in said base, associated with and proximate to each of said clip receiving elements, which receive elongated rotation preventing means therein, such that said rotation preventing means extends from said base in substantially parallel relation to the receiving element proximate thereto, said rotation preventing means and said receiving element proximate thereto being adapted to be received within the elongated clip opening and cooperating to prevent rotation of the clips during mounting thereof on said base.

2. The apparatus of claim 1 further comprising rotation preventing means and means on said rotation preventing means for frictionally engaging said aperture.

3. The apparatus of claim 2 wherein said rotation preventing means comprises an elongated rotation preventing element.

4. The apparatus of claim 3 wherein said rotation preventing element has a substantially circular cross-section.

5. The apparatus of claim 1 adapted for use with a fixture comprising a support and a pair of spaced substantially parallel rotation preventing means, mounted on and extending from said support, said base being adapted to be placed on said fixture such that said rotation preventing means extend through said apertures.

6. The apparatus of claim 5 wherein said fixture comprises a support and elongated rotation preventing means extending from said support in substantially parallel relation, spaced apart a distance substantially equal to the distance between the apertures on said base.

7. The apparatus of claim 5 wherein said rotation preventing means comprise first and second spaced elongated rotation preventing elements.

8. The apparatus of claim 7 wherein said base apertures have a larger inner dimension than the outer dimension of said rotation preventing elements.

9. The apparatus of claim 7 wherein said base apertures are substantially circular and said rotation preventing elements have a substantially circular cross-section.

10. The apparatus of claim 1 further comprising fixture adapted to be used with said base, the fixture comprising said rotation preventing means in the form of first and second spaced, substantially parallel rotation preventing elements adapted to align with and extend through the base apertures such that each rotation preventing element and the clip receiving element proximate thereto is adapted to be received within an elongated clip opening so as to prevent rotation of the clip during mounting thereof on the base.

* * * * *